US005234562A

United States Patent [19]

Uenishi et al.

[11] Patent Number: 5,234,562

[45] Date of Patent: Aug. 10, 1993

[54] ELECTROPLATING APPARATUS FOR COATING A DIELECTRIC RESONATOR

[75] Inventors: Yoshitsugu Uenishi, Ikoma; Tsuneshi Nakamura, Hirakata; Noboru Hisada, Yamatokouriyama; Yoshiyuki Makino, Yao, all of Japan

[73] Assignee: Matsushita Electric Industrial Co., Ltd., Osaka, Japan

[21] Appl. No.: 555,415

[22] PCT Filed: Nov. 7, 1989

[86] PCT No.: PCT/JP89/01140

§ 371 Date: Jul. 20, 1990

§ 102(e) Date: Jul. 20, 1990

[87] PCT Pub. No.: WO90/05389

PCT Pub. Date: May 17, 1990

[30] Foreign Application Priority Data

| | | | |
|---|---|---|---|
| Nov. 7, 1988 | [JP] | Japan | 63-280810 |
| Dec. 19, 1988 | [JP] | Japan | 63-320993 |
| Sep. 22, 1989 | [JP] | Japan | 1-246819 |

[51] Int. Cl.[5] ..... C25D 17/08; H01P 7/04

[52] U.S. Cl. ..... 204/199; 118/423; 118/500; 204/297 R; 204/297 W

[58] Field of Search ..... 205/162, 163; 204/199, 204/285, 297 R, 297 W; 118/500, 423

[56] References Cited

U.S. PATENT DOCUMENTS

| | | | |
|---|---|---|---|
| 1,836,066 | 12/1931 | Edison | 204/199 |
| 3,028,835 | 4/1962 | Rodriguez | 118/500 |
| 4,414,244 | 11/1983 | Timberlake et al. | 427/105 |
| 4,421,627 | 12/1983 | LeBaron | 204/297 |
| 4,668,925 | 5/1987 | Towatari et al. | 333/219 |
| 4,734,179 | 3/1988 | Trammel | 204/199 |
| 4,834,796 | 5/1989 | Kondo et al. | 106/1.23 |
| 4,871,108 | 10/1989 | Boecker et al. | 228/122 |
| 4,894,124 | 1/1990 | Walsh et al. | 204/30 |
| 4,913,784 | 4/1990 | Bogenschütz et al. | 204/29 |

FOREIGN PATENT DOCUMENTS

| | | |
|---|---|---|
| 54-108544 | 8/1979 | Japan . |
| 58-166806 | 10/1983 | Japan . |
| 58-182901 | 10/1983 | Japan . |
| 61-121501 | 6/1986 | Japan . |

OTHER PUBLICATIONS

Leon I Maissel et al, Hankbook of Thin Film Technology, McGraw-Hill Book Co., New York, 1970, pp. 7-23.

Metal Finishing Guidebook and Directory for 1975, Metals and Plastics Publications, Inc., Hackensack, N.J., pp. 134-139.

H. Sato et al., "High Dielectric Constant Ceramics Applied to Microwave Resonators," 3rd IEEE/CHMT International Electronic Manufacturing Technology Symposium. (Oct. 12-14, 1987), pp. 149-153.

*Primary Examiner*—John Niebling
*Assistant Examiner*—William T. Leader
*Attorney, Agent, or Firm*—Panitch Schwarze Jacobs & Nadel

[57] ABSTRACT

A resonator of dielectric ceramic includes a cylindrical body (40) having a bore (50) extending axially through the body, wherein the outside surface of the body (40) and the inside surface of the bore (50) covered with a deposited electrode (80), thereby enhancing the Q characteristics. This principal object of the invention is achieved by roughening at least a part of the outside surface of the body and then chemically etching the roughened body. The dually roughened body (40) is supported by supporting pins((110) fixed to a rotor (100) submerged in a plating bath (26), the rotor being vertical or inclined to a horizontal plane so that the body is provided with a deposited electrode (80). The surface of the rotor is provided with hills and valleys, the supporting pins being fixed on the hills. The rotor may additionally include apertures between the pins to allow the plating agent to pass through.

14 Claims, 12 Drawing Sheets

ELECTROPLATING APPARATUS FOR COATING A DIELECTRIC RESONATOR

TECHNICAL FIELD

The present invention relates to a dielectric resonator used for generating microwaves, a process for producing same and an electroplating apparatus used for carrying out the process.

BACKGROUND ART

In line with recent developments of information communication equipment such as space communication and automobile telephones, there is a strong demand for dielectric resonators for use in generating microwaves. In addition, there is a demand for compact, high efficient and inexpensive resonators.

FIGS. 14(A) and (B) show a typical example of a known dielectric resonator, the former showing a perspective view and the latter showing a cross-sectional view. The configuration common to the known resonators is cylindrical as shown in FIGS. 14(A), (B), but the configuration can vary such as rectangular and polygonal. The cylindrical configuration is particularly advantageous in that it ensures an excellent spuriaus effect. In FIGS. 14(A), (B) the resonator is composed of a body 1 of dielectric ceramics having a bore 2 and an electrode 3.

The resonator is produced first by molding a raw dielectric ceramic into the body 1 of a desired shape and sintering it at an elevated temperature. The body 1 including the inside surface of the bore 2 is wholly or partly coated with a conductive pasty mixture of silver powder and glass frit, and then is sintered at a high temperature between 600° to 800° C., thereby producing the electrode 3 in a film having a thickness of 10 to 20μ. Recently, in order to reduce the production cost and speed up production, an electroless plating method is directly applied to the body 1, thereby producing the electrode 3.

However, the former resonator is likely to be expensive because of the silver component. In addition, the Q value drops owing to the interposition of the glass between the silver and the body 1. What is more, it is difficult to evenly coat the inside surface of the bore 2, thereby preventing mass production.

The electroless plating process is disclosed in Japanese Laid-Open Patent Publication No. 54-108544.

The disadvantage of the electroless plating is that the body 1 is subjected to a lot of bulges because of weak bond between the body 1 and the copper film.

In order to solve the problem of bulging, one proposal is that the copper film is heat treated in an inert gas such as Ni or Ar (Japanese Laid-Open Patent Publication No. 58-166806). Another proposal is that prior to applying the electroless plating, the surface of the body 1 is roughened with an acid mixture containing a degreasing agent and hydrofluoric acid, and then the copper film formed thereon by the electroless plating is heat treated at a reducing atmosphere or at a weak acid atmosphere (Japanese Laid-Open Patent Publication No. 61-121501).

The heat treatment at an inert gas atmosphere, a reducing atmosphere and a weak acid atmosphere may improve the strength of bond but thermal-shock tests have uncovered that the resulting resonators are liable to bulging on the plated film, wherein the thermal-shock tests were conducted about 100 cycles under hard conditions (−60° to +115° C., each temperature being maintained for 30 minutes), and that the Q value of the resonator decreases. Presumably the detrimental bulging and reduction in the Q value results from the fact that the heat-impact test weakens the bond between the plated film and the body 1.

SUMMARY OF THE INVENTION

The present invention is to provide a dielectric resonator and a process for producing same, which overcome the bulging problem, and achieve economy in production, and enhances the reliability.

According to the present invention, a resonator of dielectric ceramic includes a cylindrical body having a bore. The body is wholly or partly roughened first mechanically, and then chemically as by etching. After the powdery leftovers on the body are removed, an electrode is formed by metallic plating.

The dually roughened surfaces of the body secure a strong bond between the deposited electrode and the body. Thus, the present invention enhances the economy in production, improves microwave characteristics and reliability of dielectric resonators.

DESCRIPTION OF THE BEST PREFERRED EMBODIMENT

Figure 1:
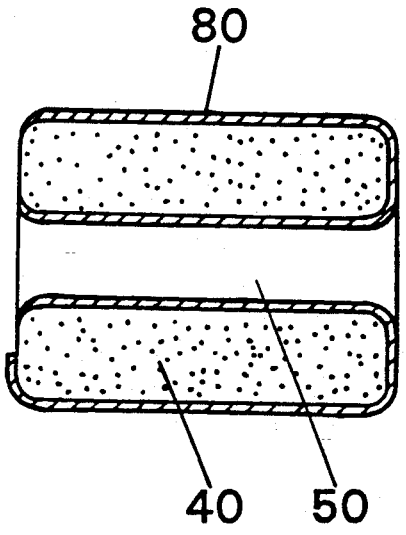
FIGS. 1, 2(A)–(C) and 3(A)–(C) are cross-sectional views showing the steps of producing a dielectric resonator according to the present invention.
Figure 2A:
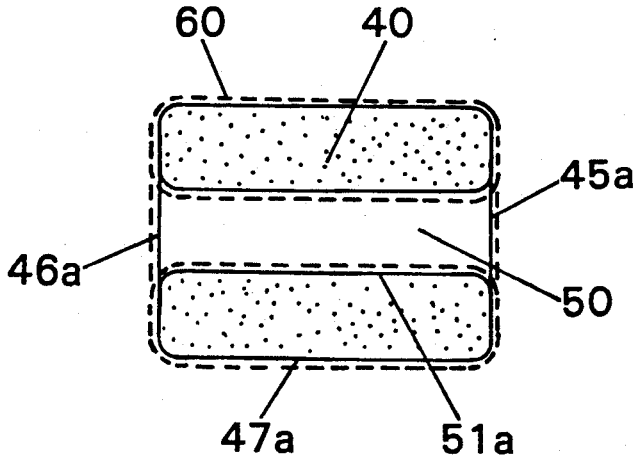
Figure 2B:
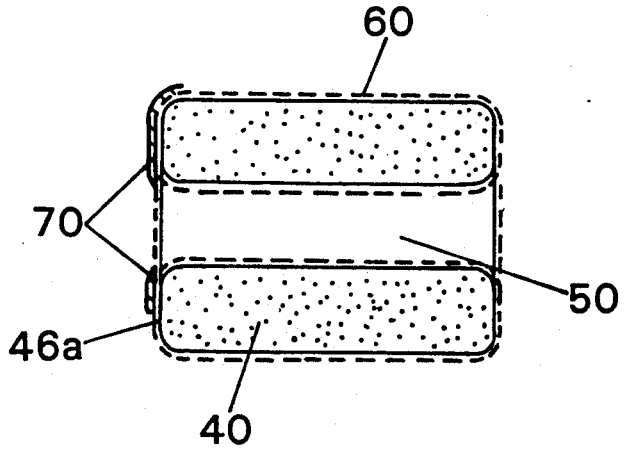
Figure 2C:
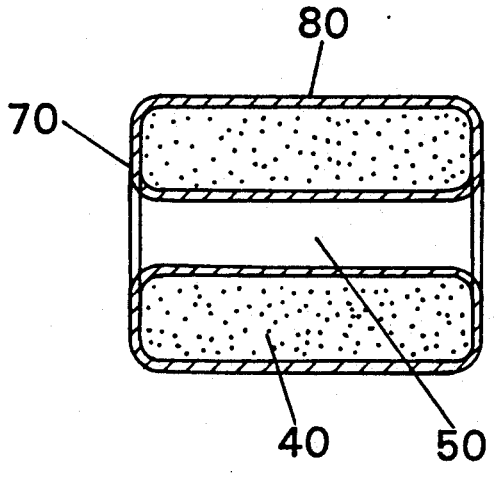
Figure 3A:
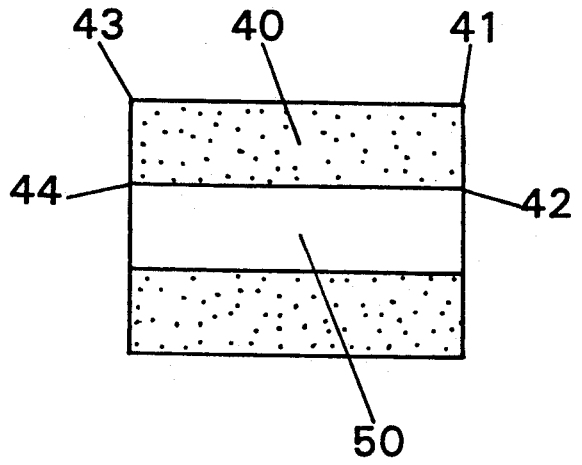
Figure 3B:
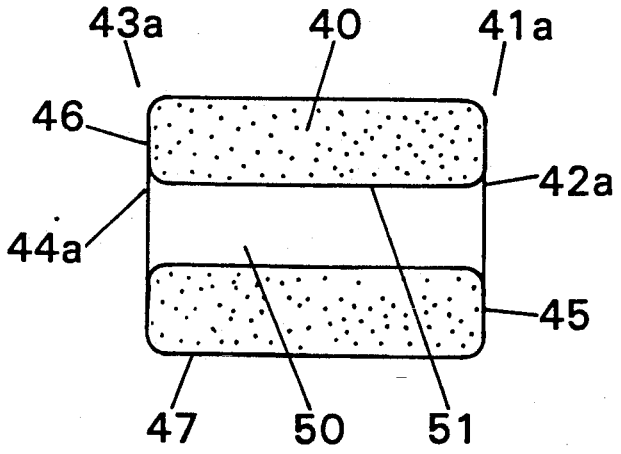
Figure 3C:
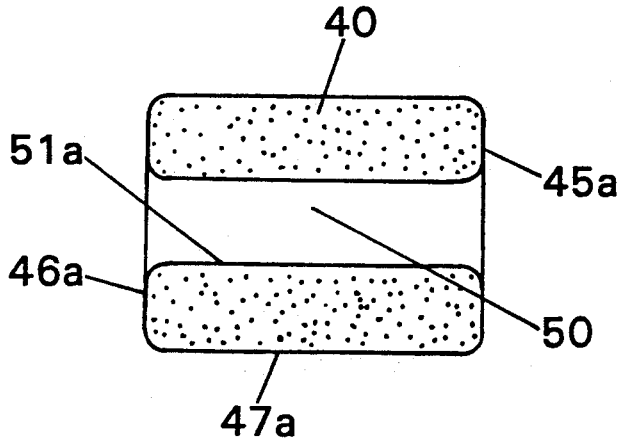

Referring to FIGS. 1 to 3, $BaO\text{-}TiO_2$, $ZrO_2SnO_2\text{-}TiO_2$, $BaO\text{-}SM_2O_3\text{-}TiO_2$, $BaO\text{-}Nd_2O_3\text{-}TiO_2$, $CaO\text{-}TiO_2\text{-}SiO_2$ can be used as dielectric ceramic. First, a body 40 having a bore 50 is produced by use of one of these substances as shown in FIG. 3(A). The entire surface including the inside surface of the bore 50 had a roughness (Rz) of 1.0 to 2.5μ which is measured by a surface scanning method. Then, the surface of the body 40 is roughened mechanically by means of a barrel abrading machine or a blast device. The ridges 41 to 44 became rounded into round corners 41*a* to 44*a* as shown in FIG. 3(B). The same roughening operation also roughens the surfaces and produces rough surfaces 45 to 47, which will be referred to as the "first uneven surface". The first uneven surface had a roughness (Rz) of 4.0 to 9.5μ. The inside surface 51 of the bore 50 remains out of the roughening operation because of the difficulty in inserting a roughening tool deep into the bore 50. Therefore, the roughness (Rz) is 1.0 to 2.5μ.

Subsequently the body 40 is subjected to an etching treatment with an HF-content reagent so that a second uneven surfaces 45*a* to 47*a* are overlaid on the first uneven surfaces 45 to 47. The roughness (Rz) of the second uneven surfaces 45*a* to 47*a* is in the range of 5.0 to 10.5μ. The inside surface 51*a* of the bore 50 is also roughened to 2.0 to 3.5μ Rz.

Figure 4A:
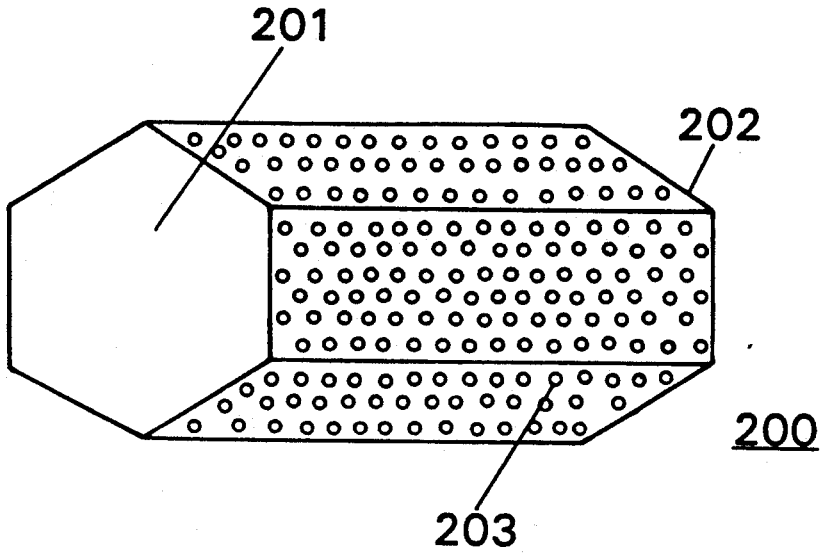
FIG. 4(A) is a perspective view showing an apparatus for carrying out the process of FIGS. 1–3.

The next step is to clean the body 40 by a supersonic wave bath so as to remove powdery leftovers on the second uneven surfaces 45*a* to 47*a*. If these powdery leftovers remains on the surfaces of the body 40 and the inside surface 51*a* of the bore 50 they are likely to stay between the electrode 80 (in FIG. 2) and the body 40, thereby preventing the contact therebetween. For this reason the removal of powdery leftovers is required. The method of removing the powdery leftovers will be described by reference to FIG. 4:

In FIGS. 4(A) and (B) there is provided a barrel 200 which is composed of a hexagonal end wall 201 and 202 and a hexagonal network 203 extended over the end walls 201 and 202. The network has pores of 3 mm in diameter. The barrel 200 is preferably made of metal. The metal barrel 200 and the network 203 allow the supersonic wave from an oscillator 400 to pass through, thereby increasing the cleaning efficiency. In the illustrated embodiment, the end walls 201, and 202, and the network 203 are made of SUS 304 having a thickness of 1.5 mm (t), and the porosity is about 50%. The diameter of the pore is not limited to 3 mm, but the mesh is decided so that the network 203 can retain the body 40 thereon. However, if the barrel 200 has no pore, the following problems will arise:

(1) When the barrel 200 is submerged in the reagent, any bubble reduces the effectiveness of supersonic wave cleaning.

(2) After the powdery leftovers is removed from the body 40, a residue remains in the barrel 200, which is likely to move about in the confined space in the barrel 200, thereby reducing the efficiency of supersonic wave cleaning.

This is why the porous network is employed. The etched body 40 is placed in the barrel 200 through an entrance (not shown).

Figure 4B:
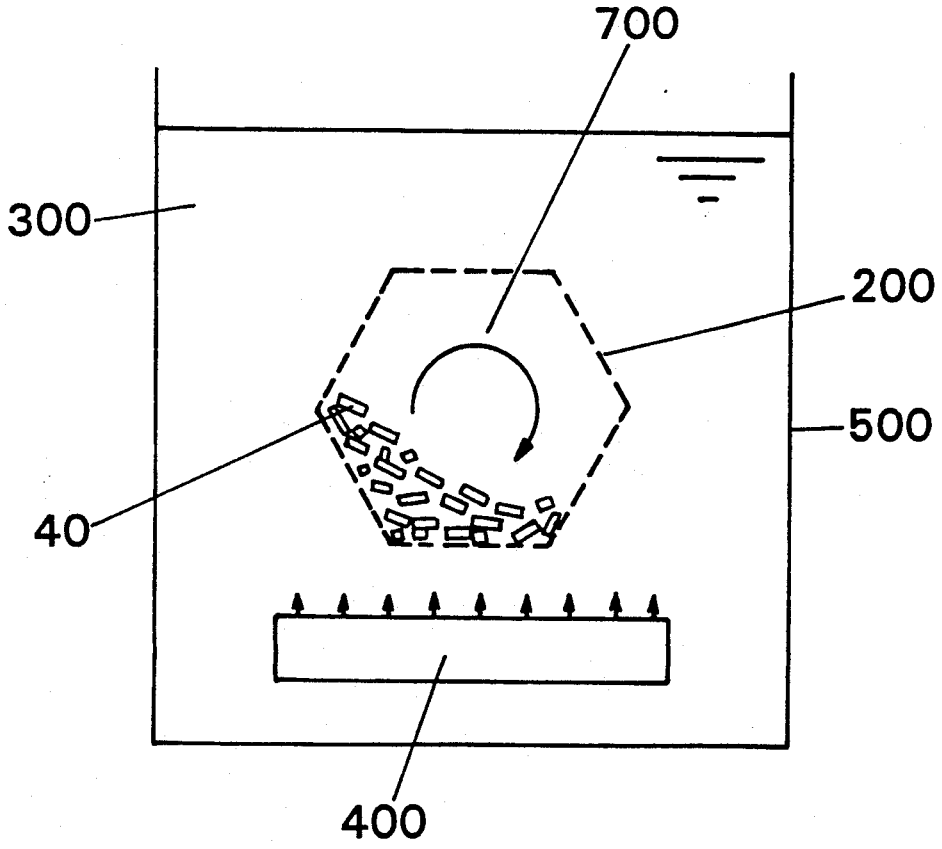
FIG. 4(B) is a cross-sectional view showing the apparatus of FIG. 4(A)

Referring to FIG. 4(B), a container 500 holding water or reagent 300, is prepared. The oscillator 400 is placed on the bottom of the container 500 adjacent to which the barrel 200 accommodating the bodies 40 is placed so that it can rotate in the direction of arrow 700 (the direction is not limited to it) at about 4 to 7 rpm. The frequency of the oscillator is preferably 28 to 40 KHz, and it is preferred that the amount of bodies 40 does not exceed 40% of the capacity of the barrel 200. If the amount exceeds it, the confined bodies 40 are difficult to rotate smoothly in accordance with the rotation of the barrel 200. The rotating bodies 40 in the barrel 200 submerged in the container 500 are irradiated with supersonic wave. As a result, fine vacuum bubbles are produced near the surfaces of the bodies 40, and collide with each other, thereby generating strong energy impinging on the surfaces of the bodies 40. In this way the powdery leftovers on the bodies 40 are removed therefrom. After the surfaces of the bodies 40 treated with stannous chloride solution or the like so as to increase the sensitivity of all the surfaces 45*a*, 46*a*, 47*a* and 51*a*, and are then activated with palladium chloride so as to cover all the surfaces of the bodies 40 with a catalytic coat 60 of palladium as shown in FIG. 2(A). The step advances to that of FIG. 2(B) where a resist ink is wholly or partly coated on one of the end walls 46*a* by a screen printing method. The resist ink is allowed to dry and harden into a resist layer 70, which advantageously prevents an electrode 80 from forming on the resist layer 70 in the plating process as shown in FIG. 2(C).

The electrode 80 is made in the following manner:

In the plating process the bodies 40 are subjected to electroless plating in a bath containing copper sulfate, EDTA, formaldehyde, and NaOH. In this way the electrode 80 of metallic film having a thickness of 3 to 13μ is formed on a portion on which the palladium 60 is exposed. If necessary, another metal film can be formed to 3 to 15μ either by a electroless plating method or an electroplating method.

Even after the metallic electrode 80 is formed, the resist layers 70 may remain, particularly for types of resonators having no mechanical sliding part designed to vary the electric capacity. In this case, resist ink capable of hardening by heat or by ultra violet is handy to treat for the plating. On the other hand, dielectric resonators having a mechanical sliding part (not shown) should use resist ink removable by an alkaline solution or a solvent. FIG. 1 shows the body 40 having the resist ink 70 removed.

The characteristics of the resonators according to the present invention will be described by way of example so as to enable one to assess the superiority of the present invention over the comparative example:

EXAMPLE 1

A ceramic body 40 of $BaO\text{-}TiO_2$ having an outside diameter of 6.0 mm, an inside diameter of 2.0 mm and a length of 8.0 mm was facially abraded to Rz=6.0μ by a barrel abrading machine. Then the body 40 was treated in an etching reagent containing $HF\text{-}HNO_3$ for 20 minutes. The resulting powdery leftovers were removed in a barrel 200 by a supersonic wave cleaning method for 30 minutes. After cleansing with water, the body 40 was treated with a stannous chloride solution so as to improve the sensitivity and then with a palladium chloride solution so as to increase the activation. After drying, resist ink 70 was coated on the end wall 46*a*, and after the resist ink 70 dried, the body 40 was subjected to electroless plating in a bath containing copper sulfate, EDTA, formaldehyde, and NaOH, and coated with a copper film of 3μ thick. After cleansing, the body 40 was subjected to electroplating with silver and coated with a silver film of 15μ thick. After cleansing and drying, the bodies treated in this way were assembled into 100 pieces of resonators. These are referred to as Sample No.1. Thirty pieces (n=30) were selected from the Sample No.1 at random, and the characteristics of them were assessed. The characteristics are shown in Table 1, wherein the thickness of the plated film, the Q characteristic of high frequency is represented in terms of Q value at non-load, and the strength of bond between the electrode 80 and the body 40 is represented as the means value of the thirty resonators. The strength of bond between the electrode 80 and the body 40 was measured by the following manner: a copper wire with a nail head having a diameter of 0.8 mm was vertically soldered to the electrode 80 (in the Sample No.1, it was copper film) of the resonator at its head. The soldered area was 4 $mm^2$. The copper wire was pulled at a speed of 40 mm/min, and the breaking strength was measured. The assessment of the characteristics and the method of measuring breaking strength were the same throughout the following examples.

EXAMPLE 2

A ceramic body 40 of $BaO-TiO_2$ having an outside diameter of 6.0 mm, an inside diameter of 2.0 mm and a length of 8.0 mm was facially abraded to Rz=9.5 by a blasting device. Then the body 40 was treated in an etching reagent containing $HF-HNO_3$ for 20 minutes. The resulting powdery leftovers were removed in a barrel 200 by a supersonic wave cleaning method for 30 minutes. After cleaning with water, the body 40 was treated with a stannous chloride solution so as to improve the sensitivity and then with a palladium chloride solution so as to increase the activation. After drying, resist ink was coated on the end wall 46*a* as shown in FIG. 2(B). After the resist ink was allowed to dry so as to form a resist layer 70, the body 40 was subjected to electroless plating in a bath containing copper sulfate, EDTA, formaldehyde, and NaOH, and coated with a copper film of 13μ thick. Following cleansing, the body 40 was subjected to another electroless plating with nickel, and coated with a nickel film of 3μ. After cleansing and drying, the bodies treated in this way were assembled into 100 sets of resonators. These are referred to as Sample No.2. Thirty sets (n=30) were selected from the Sample No.2 at random, and the characteristics of them were assessed as shown in Table 1.

EXAMPLE 3

A ceramic body 40 of $BaO-TiO_2$ having a diameter of 6.0 mm, an inside diameter of 2.0 mm and a length of 8.0 mm was facially abraded to Rz=4μ by a barrel abrading device. Then the body 40 was treated in an etching reagent containing $HF-HNO_3$ for 20 minutes. The resulting powdery leftovers were removed in a barrel 200 by a supersonic wave cleaning method for 30 minutes. After cleansing with water, the body 40 was treated with a stannous chloride solution so as to improve the sensitivity and then with a palladium chloride solution so as to increase the activation. After drying, resist ink 70 was coated on the end wall 46*a* as shown in FIG. 2(B), and after the resist ink 70 dried, the body 40 was subjected to electroless plating in a bath containing copper sulfate, EDTA, formaldehyde, and NaOH, and coated with a copper film of 13μ thick. After cleansing and drying, the bodies treated in this way were assembled into 100 sets of resonators. These are referred to as Sample No.3. Thirty sets (n=30) were selected from the Sample No.3 at random, and the characteristics of them were assessed as shown in Table 1.

COMPARATIVE EXAMPLE 1

A ceramic body 40 of $BaO-TiO_2$ having a diameter of 6.0 mm, an inside diameter of 2.0 mm and a length of 8.0 mm was facially abraded to Rz=6.0μ by a barrel abrading machine. After cleansing with water, the body 40 was treated with a stannous chloride solution so as to improve the sensitivity and then with a palladium chloride solution so as to increase the activation. After drying, resist ink was coated on the end wall 46*a* as shown in FIG. 2(B), and after the resist ink was allowed to dry so as to form a resist layer 70, the body 40 was subjected to electroless plating in a bath containing copper sulfate, EDTA, formaldehyde, and NaOH, and coated with a copper film of 3μ thick. After cleansing, the body 40 was subjected to electroplating with silver and coated with a silver film of 15μ thick. After cleansing and drying, the bodies treated in this way were assembled into 100 sets of resonators. These are referred to as Sample No.4. Thirty sets (n=30) were selected from the Sample No.4 at random, and the characteristics of them were assessed.

COMPARATIVE EXAMPLE 2

A ceramic body 40 of $BaO-TiO_2$ having a diameter of 6.0 mm, an inside diameter of 2.0 mm and a length of 8.0 mm was treated in an etching reagent containing $HF-HNO_3$ for 20 minutes The resulting powdery leftovers were removed in a barrel 200 by a supersonic wave cleaning method for 30 minutes. After cleansing with water, the body 40 was treated with a stannous chloride solution so as to improve the sensitivity and then with a palladium chloride solution so as to increase the activation. After drying, resist ink was coated on the end wall 46*a* as shown in FIG. 2(B), and after the resist ink was allowed to dry so as to form a resist layer 70, the body 40 was subjected to electroless plating in a bath containing copper sulfate, EDTA, formaldehyde, and NaOH, and coated with a copper film of 3μ thick. After cleansing, the body 40 was subjected to electroplating with silver, and coated with a silver film of 15μ. The bodies treated in this way were assembled into 100 sets of resonators. These are referred to as Sample No.5. Thirty sets (n=30) were selected from the Sample No.5 at random, and the characteristics of them were assessed as shown in Table 1.

COMPARATIVE EXAMPLE 3

A ceramic body 40 of $BaO-TiO_2$ having a diameter of 6.0 mm, an inside diameter of 2.0 mm and a length of 8.0 mm was facially abraded to Rz=6.0μ by a barrel abrading machine. Then the body 40 was treated in an etching reagent containing $HF-HNO_3$ for 20 minutes. After cleaning, the body 40 was treated with a stannous chloride solution so as to improve the sensitivity and then with a palladium chloride solution so as to increase the activation. After drying, resist ink was coated on the end wall 46*a* as shown in FIG. 2(B), and after the resist ink was allowed to dry so as to form a resist layer 70, the body 40 was subjected to electroless plating in a bath containing copper sulfate, EDTA, formaldehyde, and NaOH, and coated with a copper film of 3μ thick. After cleansing, the body 40 was subjected to electroplating with silver and coated with a silver film of 15μ thick. After cleansing and drying, the bodies treated in this way were assembled into 100 sets of resonators. These are referred to as Sample No.6. Thirty sets (n=30) were selected from the Sample No.6 at random, and the characteristics of them were assessed.

COMPARATIVE EXAMPLE 4

After a ceramic body 40 of $BaO-TiO_2$ having a diameter of 6.0 mm, an inside diameter of 2.0 mm and a length of 8.0 mm was cleansed with water, it was treated with a stannous chloride solution so as to improve the sensitivity and then with a palladium chloride solution so as to increase the activation. After drying, resist ink was coated on the end wall 46a as shown in FIG. 2(B), and after the resist ink was allowed to dry so as to form a resist layer 70, the body 40 was subjected to electroless plating in a bath containing copper sulfate, EDTA, formaldehyde, and NaOH, and coated with a copper film of 3μ thick. After cleansing, the body 40 was subjected to electroplating with silver, and coated with a silver film of 15μ. The bodies treated in this way were assembled into 100 sets of resonators. These are referred to as Sample No.7. Thirty sets (n=30) were selected from the Sample No.7 at random, and the characteristics of them were assessed as shown in Table 1.

TABLE 1

| Sample No. | Kind of Plating (thickness of deposit) | Characteristics non-load Q (X) | Characteristics strength of bond (X) |
|---|---|---|---|
| 1 | electroless (Cu) + electro (Ag) (3μ) (15μ) | 517 | 12.4 kg/4 mm² |
| 2 | electroless (Cu) + electro (Ni) (13μ) (5μ) | 495 | 13.5 kg/4 mm² |
| 3 | electroless (Cu) (13μ) | 515 | 12.8 kg/4 mm² |
| 4 | electroless (Cu) + electro (Ag) (3μ) (15μ) | 430 | 4.7 kg/4 mm² |
| 5 | electroless (Cu) + electro (Ag) (3μ) (15μ) | 418 | 5.2 kg/4 mm² |
| 6 | electroless (Cu) + electro (Ag) (3μ) (15μ) | 421 | 6.4 kg/4 mm² |
| 7 | electroless (Cu) + electro (Ag) (3μ) (15μ) | 478 | 3.7 kg/4 mm² |

Another thirty sets were taken from the remaining portion of each Sample No.1 to No.7 after the first thirty specimens were assembled into resonators, and were tested for their resistance to heat by placing them at −60° C. to +115° C. for 30 minutes. After they were subjected to the thermal stress, the appearance of characteristics of each specimen were assessed. The results are shown in Table 2, wherein the mark "O" indicates that the non-load Q value exceeds 420, and the mark "X" indicates that the non-load Q value is smaller than 420.

TABLE 2

| Sample No. | Outward Appearance | Tests of Thermal Shock Characteristics non-load Q (X) | Tests of Thermal Shock Characteristics strength of contact (X) | decision |
|---|---|---|---|---|
| 1 | good (no bulge) | 512 | 12.7 kg/4 mm² | O |
| 2 | good (no bulge) | 503 | 12.9 kg/4 mm² | O |
| 3 | good (no bulge) | 527 | 13.1 kg/4 mm² | O |
| 4 | partly bulged | 391 | 5.9 kg/4 mm² | X |
| 5 | partly slightly bulged | 384 | 6.1 kg/4 mm² | X |
| 6 | entirely bulged | 376 | 5.3 kg/4 mm² | X |
| 7 | partly bulged | 208 | 4.2 kg/4 mm² | X |

As is evident from Tables 1 and 2, the dielectric resonators according to the present invention have a relatively high non-load Q value. In addition, the non-load Q value varies within ±5% after the thermal stress tests. The tests also reveal that the strength of contact of the electrode 80 is not unfavorably affected by the tests but are 12.0 kg/4 mm² or more. This tells that the resonators withstand the heat transmitted by welding and/or any mechanical stress (as demonstrated by drop tests or vibration tests), thereby ensuring that the electrodes 80 is secured to the the bodies 40. It will be appreciated from the test results that the resonators of the present invention are reliable.

The present invention is applicable not only to dielectric resonators but also to to circuit substrates for microwaves or the formation of electrodes for chip components.

According to the present invention, the heat treatment requires no atmospheric condition such as an inert gas atmosphere, a reducing gas atmosphere or a weak acid atmosphere, thereby eliminating the necessity of having any equipment required to maintain such atmospheric conditions. This results in reduced production cost, and simplifies the process, that is, the dry process (mechanical roughening) and the wet process (chemical roughening by etching and removal of powdery leftovers), thereby achieving the mass production of resonators on the reduced process.

The inside surface 51a of the bore 50 has a smaller roughness (Rz) than that of the outside surface of the body 40. This smoothness is of particular advantage when a metal rod or a metal spring is inserted into the bore 50 so as to provide an earth, in that the bond between the inserter and the inside surface 51a of the bore 50 is maintained.

As shown in FIG. 3(B), because of the rounded corners 41a to 44a the continuous electrode 80 is maintained by the plated film even though the film is as thin as 10μ. The rounded corners 42a and 44a are particularly effective to facilitate the smooth insertion of the metal rod or spring through the bore 50.

Figure 5A:
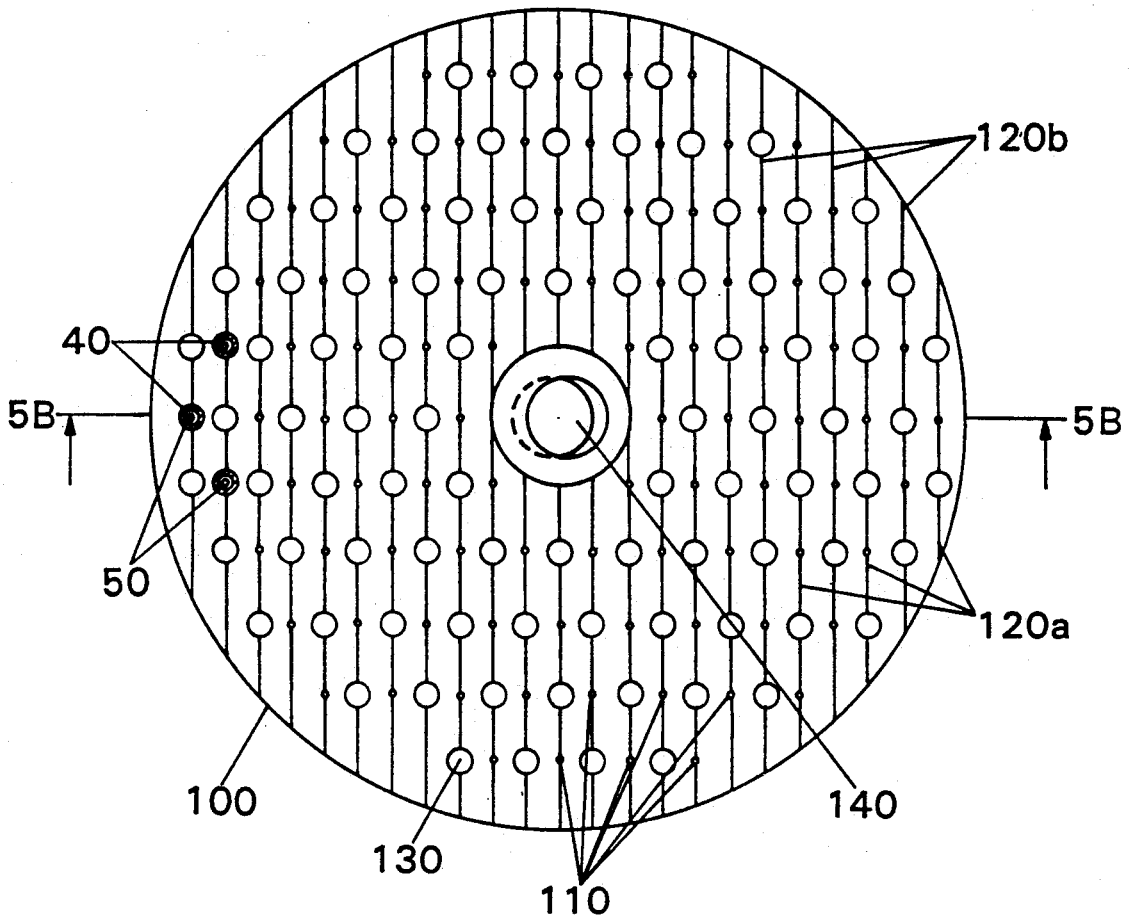
FIG. 5(A) is a plan view showing a rotor of a plating device for carrying out the process of FIGS. 1–3.
Figure 5B:
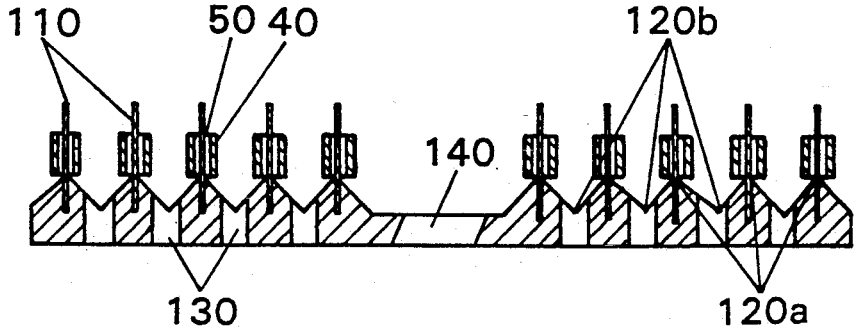
FIG. 5(B) is a cross-section taken along the line Z—Z in FIG. 5(A)

Referring to FIGS. 5 to 9, a plating device for making the electrode 80 will be described:

In FIG. 5, there is provided a rotor 100, which is made of plastics such as heat-proof PVC, polyethylene, polypropylene, or alternatively, plastic-coated metal, such as SUS 304 and SUS 316, each coated with the above-mentioned plastics. The used material is preferably resistant to the etching reagent whose temperature rises as high as 50° to 70° C., and capable of allowing no metal to deposit. The rotor 100 is provided with supporting pins 110 upright on its surface. The pins 110 are preferably made of a substance which allows the plating metal to deposit. The surface of the rotor 100 is provided with hills 120a and valleys 120b, and the supporting pins 110 are planted on the hills 120a and the valleys 120b. The supporting pins 110 are inserted into the bores 50 of the bodies 40, and are retained on the rotor 100 as shown in FIG. 5(B). As is clearly shown in FIG. 5(B), each body 40 keeps point-to-point contact with the rotor 100. The reference numeral 130 denotes apertures designed to allow the plating agent to pass through so that the bodies 40 retained on the supporting pins 110 are completely submerged in the electrolyte or plating agent. A rotary shaft 20a or 20b (FIG. 6) is inserted into a rotary shaft bore 140 having its rotary axis inclined against that of the rotor 100.

Figure 6:
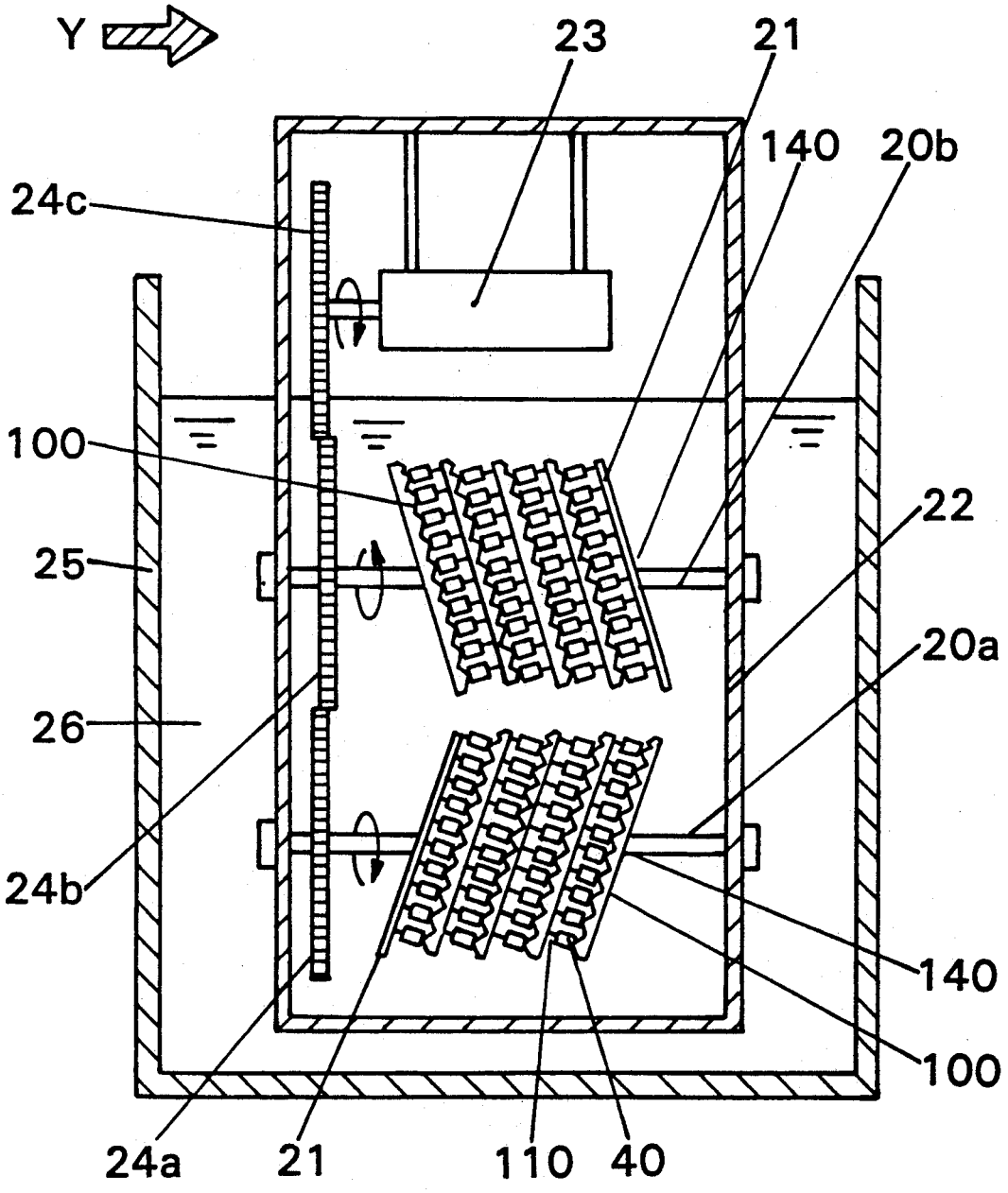
FIG. 6 is a cross-sectional side view showing a main portion of the plating device.

Referring to FIG. 6, the plating device and the plating process will be described:

There is provided a plating tank 25 holding a plating bath 26. In the plating tank 25 the rotary shafts 20a and 20b are rotatably supported on a frame 22 in parallel with each other. The rotary shafts 20a and 20b support a plurality of rotors 100 carrying the bodies 40. Because of the inclined rotary axis, the rotors 100 are inclined on the rotary shaft 20*a* and 20*b*. The plurality of rotors mounted on one rotary shaft 20*a* or 20*b* are closed by a bottom plate 21. The rotary shaft 20*a* is connected to a gear 24*a*, and the rotary shaft 20*b* is connected to a gear 24*b*. The gears 24*a* is engaged with the gear 24*b*, which is engaged with a third gear 24*c* driven by a motor 23. In FIG. 6, suppose that the gear 24*c* rotates in the clockwise direction when viewed in the Y direction, the gear 24*b* will rotate in the anti-clockwise direction, and the gear 24*a* will rotate again in the clockwise direction. The two rotors units on the shafts 20*a* and 20*b* are rotated in different directions, thereby agitating the plating bath 26 in the plating tank 25. While the rotors 100 are rotated in the plating bath 26, the bodies 40 are subjected to electroless plating, thereby forming metallic films on the bodies 40 at one time.

Figure 7:
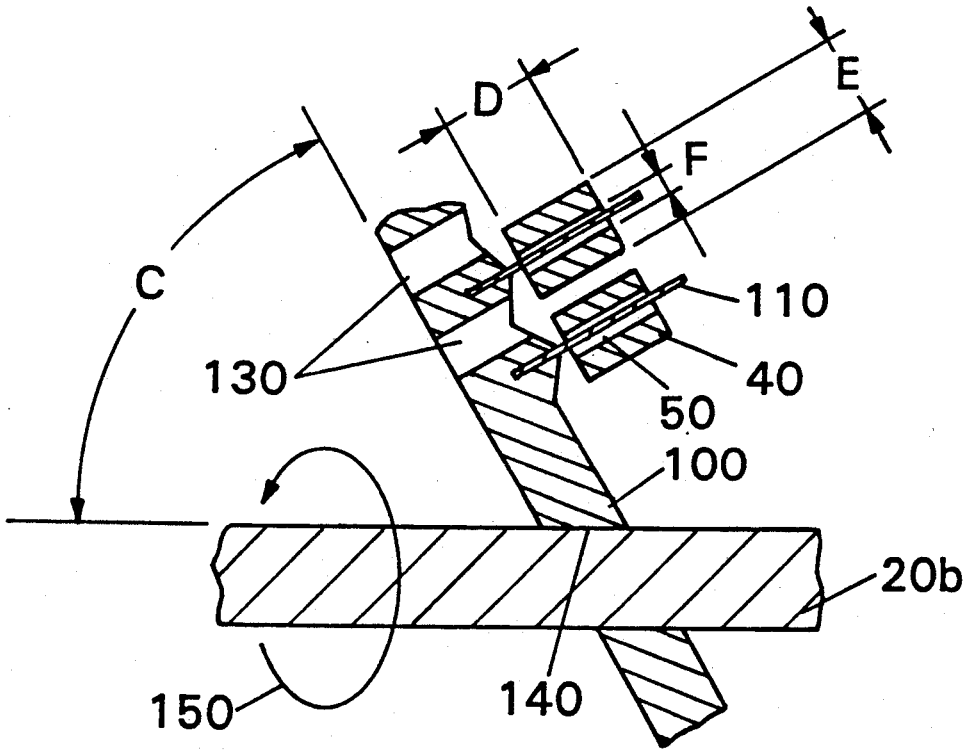
FIGS. 7–9 each are cross-sectional views showing various aspect of the positional relationship between the rotor and a supporting pin.
Figure 8:
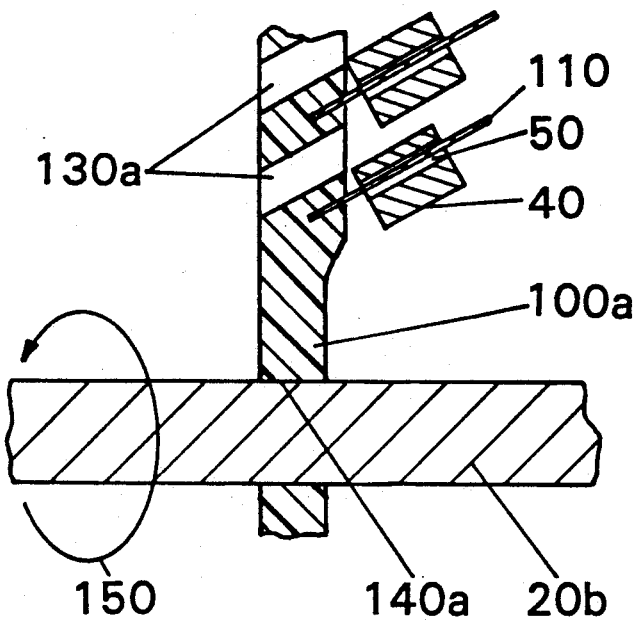
Figure 9:
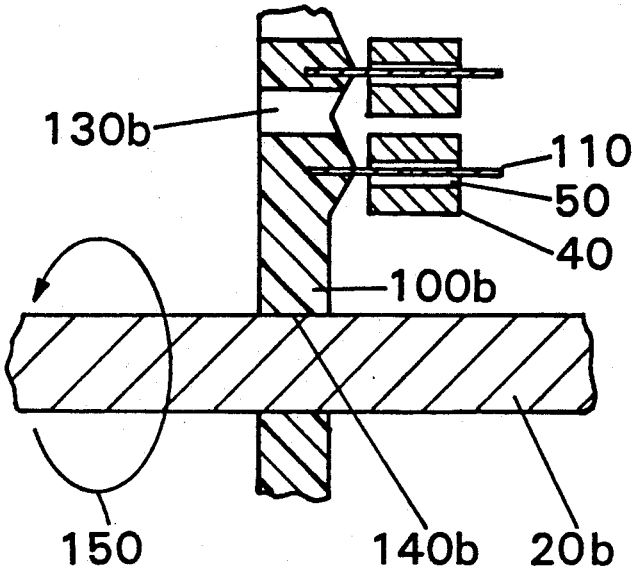

Referring to FIGS. 7 to 9, the positional relationship between the rotor 100 and the rotary shafts 24*a*, 24*b* will be described in greater detail:

In FIG. 7 the rotary shaft bore 140 has an inclined axis to that of the rotary shaft 24*a*, 24*b* so that the rotors 100 are supported at a tilt on the rotary shaft 20*a* and 20*b*. The angle of inclination (c) is preferably in the range of 60° to 75°. When the rotary shafts 20*a* and 20*b* are driven in the direction of arrow 150 at 5 to 7 rpm, the rotors 100 are rotated, the bodies 40 are rotated about the respective supporting pins 110. Because of the fact that the bodies 40 are at a tilt, the supporting pins 110 keep contact with the inside surfaces 51*a* of the bores 50 at varying spots. As a result, the plating is evenly carried out through the outside surfaces of the bodies 40 and inside surfaces 51*a* of the bores 50.

Any gas (e.g. hydrogen gas when electroless plating takes place) generated in the bores 50 through chemical reaction is removed by the supporting pins 110 and uneven plating due to the gas is prevented. The bodies 40 supported on the rotary shafts 20*a*, and 20*b* are prevented from colliding with each other. In addition, the apertures 130 allow the electrolyte to reach every part of the bodies 40, thereby effecting the complete coverage thereof.

The supporting pins 110 are preferably made of metal which allows the deposit of the plating metal on themselves. In addition, it is preferred that the pins are mechanically tough, stable to an electrolyte such as acid and alkaline solutions used as the plating bath and the reagent used for removing the deposits on the supporting pins 110. In the illustrated embodiment a glass fiber stick of 0.8 mm in outside diameter coated with a plating catalyst or a SUS 304 stick of 0.8 mm in outside diameter. As soon as the plating operation starts, metal starts to deposit on the outside surfaces of the bodies 40 and the inside surfaces 51*a* of the bores 50. The inside surfaces 51*a* of the bores 50 have deposits of the plating metal accelerated by the supporting pins 110. In this way plating areas extend over both inside and outside surfaces of the individual bodies 40, and as the chemical reaction becomes active, a greater volume of gases is generated. Thus the inside surfaces 51*a* of the bores 50 are more activated, thereby effecting the complete coverage of metal deposits.

The dimensional and positional relationships between the bodies 40 and the supporting pins 110:

The body 40 is preferably cylindrical as described above, but the configuration is not limited to it. A rectangular body is possible. FIG. 7 shows a cylindrical body as a typical configuration, having a outside diameter (E) of about 8 mm, an inside diameter (F) of about 2 mm, and a length (D) of about 8 mm. Each supporting pin 110 is cylindrical or polygonal, having an outside diameter of about 0.8 mm, and a length of about 20 mm projecting from the rotor 100. The dimensional and positional relationships are the same throughout the Examples 2 to 3.

Referring to FIG. 8, a modified version of the embodiment will be described:

A rotor 100*a* is provided with a rotary shaft bore 140*a* so that the rotor 100*a* is perpendicular to a rotary shaft 20*b* and the supporting pin 110 is planted at a tilt to the surface of the rotor 100*a*. The angle of inclination is arranged so as to be the same as the (c) shown in FIG. 7. The rotor 100*a* is also provided with apertures 130*a* which are inclined at the same angle as he supporting pins 110 are. Under this arrangement the supporting pins 110 are inserted into the bores 50 of the bodies 40, and the rotary shaft 20*b* is rotated at 5 to 7 rpm in an arrow 150 in the plating bath 26 as described above. In this way the smooth or even plating surfaces have been obtained as by the Example of FIG. 7.

Referring to FIG. 9, a further modified version of the embodiment will be described:

A rotor 100*b* is provided with a rotary shaft bore 140*b* so that the rotor 100*b* is vertical to the rotary shaft 20*b*, and the supporting pin 110 is vertically fixed to the rotor 100*b*. The rotor 100*b* is provided with apertures 130*b* that are vertical to the surface of the rotor 100*b*. Likewise, the bodies 40 are supported on the rotor 100*b* and the rotary shaft 20*b* is rotated at 50 to 70 rpm in a direction 150 in the electrolyte. In this way the smooth or even plating surfaces have been obtained as by the examples of FIGS. 7 and 8.

Table 3 shows the comparative data between the Examples 1 to 3 and the comparative examples 1 to 2.

The plating was conducted in an electroless plating agent, and the bodies 40 were made of barium-titanate base dielectric ceramic. In the comparative example 1 the bodies 40 were placed in a cage that was submerged in the plating agent, and in the comparative example 2 the bodies 40 were supported on pins fixed on a stationary pillar. In the comparative example 2 the plating was conducted with the bodies 40 being motionless.

TABLE 3

| | Plating Device | Total number (sets) | usable (sets) | unusable (sets) | yield (%) | average yield (%) |
|---|---|---|---|---|---|---|
| Example 1 | FIG. 7 | 4102 | 3989 | 113 | 97.2 | |
| Example 2 | FIG. 8 | 4082 | 3894 | 188 | 95.4 | 96.5 |
| Example 3 | FIG. 9 | 4985 | 4820 | 165 | 96.7 | |
| Comparative Example 1 | cage | 308 | 233 | 75 | 75.6 | |
| Comparative Example 2 | cage by a fixed pin | 1013 | 785 | 228 | 77.5 | 77.1 |

Table 3 shows that the yields obtained by the Examples 1 to 3 are on average greater by about 20% than those by the comparative examples 1 and 2.

After the electroless plating is finished, electroplating can be carried out by energizing through the supporting pins 110. The electroless plating takes a long time. Therefore at first a thin film is formed by electroless plating in a relatively short period of time, and after cleaning, electro-plating is applied. This double plating is effective to shorten a plating period of time.

The bodies 40 have uneven top surfaces by a roughening process but it is preferred that they have the same rough bottom surfaces Owing to the rough top and bottom surfaces, the bodies 40 and the rotor 100 keep point contact with each other, thereby securing the formation of even plated films. When the rotor 100 is made of plastic alone, it is preferred that the rotor is provided with hills and valleys on the top surfaces and on the bottom surfaces that cross each other at right angle. This expedient protects the plastic rotor from being adversely affected by curving at a high temperature that is unavoidable in the plating operation because the tendencies of curving in opposite directions on each surface mutually negate each other into no substantial curving.

Figure 10:
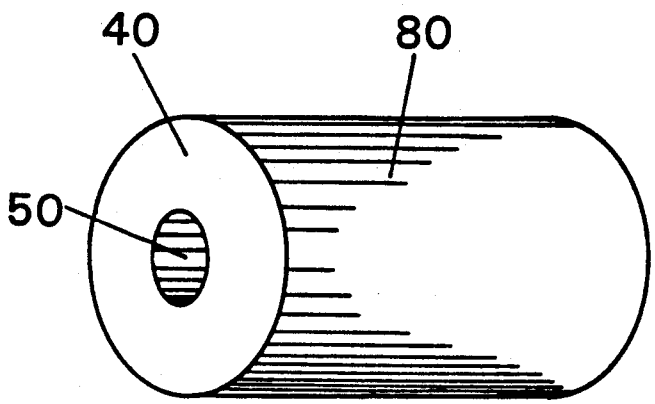
FIG. 10 is a perspective view showing a modified version of the dielectric resonator according to the present invention.
Figure 11:
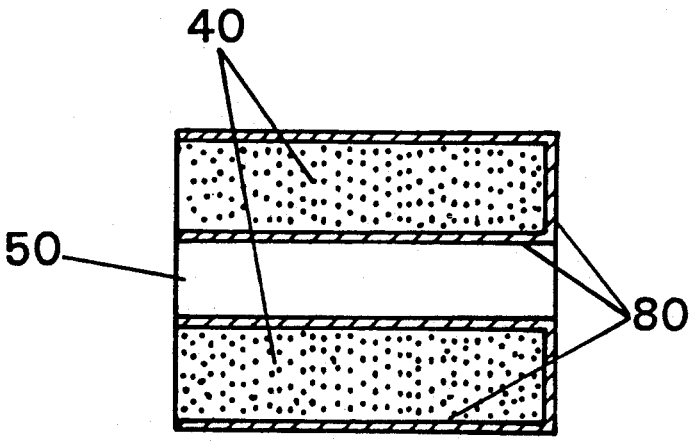
FIG. 11 is a cross-sectional view showing the dielectric resonator.

The electrolyte or plating agent used in the device of FIG. 6 will be described:

Referring to FIGS. 10 and 11, the reference numeral 40 denotes a body obtained by sintering strong electromagnetic ceramic, having a bore 50 and an electrode 80 deposited by electroless plating.

The body 40 is extruded into a cylindrical shape through a suitable mold, and sintered at an elevated temperature (1000° C. or more).

The material is selected from $BaO-TiO_2$, $ZrO_2-SnO_2-TiO_2$, $BaO-Nd_2O_3-TiO_2$, and $CaO-TiO_2-SiO_2$. In the illustrated embodiment $BaO-TiO_2$ was used.

The body 40 was abraded by a barrel abrading device so as to make rounded corners, and was submerged in an etching reagent such as hydrofluoric acid and phosphoric acid, so that the outside surface of the body 40 and the inside surface of the bore 50 were finely roughened.

Subsequently, the roughened body 40 was submerged first in a stannous chloride solution (0.05 g/L), and then in a palladium chloride (0.1 g/L) so as to increase the activation, thereby covering the body 40 including the inside surface of the bore 50 with a catalytic layer having a core of palladium particles.

If necessary, one of the end faces of the body 40 can be covered with a resist layer so as to prevent an electrode from being formed thereon, wherein the resist layer is resistant to the electroplating. Then, the activated body 40 was submerged in an electroless plating agent so that copper was deposited on the body 40 covered with the catalytic layer, thereby forming the electrode 80 of 5 to 10μ thick. The electroless plating agent had the following composition, and the plating was conducted at a temperature ranging from 60° to 80° C.:

| | |
|---|---|
| Copper sulfate | 0.030 to 0.050 M/L |
| EDTA | 0.035 to 0.100 M/L |
| Formaldehyde | 5 to 10 ml/L |
| Sodium hypophosphite | 0.05 to 0.100 M/L |
| 2,2'bipyridyl | 10 mg/L |
| PH | 12.0 to 13.0 |

It has been found that the dielectric resonator having the electrode 80 of $BaO-TiO_2$ has a higher Q value by about 30% than that of a conventional resonator that is subjected to copper electroless plating with the use of Rochelle salt at a low temperature (40° C.).

Under the treatment using Rochelle salt at a low temperature, copper is likely to deposit at a relatively high speed,, and hydrogen gas and univalent copper oxide ($Cu_2O$) are contained in the copper deposit, thereby reducing the purity of the copper layer. In addition, the copper deposit is blackened and coarse crystal results. What is worse, the Q value is low because of insufficient bond between the deposited copper and the surfaces of the body 40. In contrast, according to the present invention, the electroless plating agent comprises a basic bath containing EDTA for forming copper complex ions, and formaldehyde as a reducing agent, with the addition of a small amount of 2,2'bipyridyl and a large amount of sodium hypophosphite. When the plating is carried out in this electrolyte at such high temperatures as 60° to 80° C., the 2,2'bipyridyl prevents the deposit of univalent copper oxide and the intrusion of hydrogen gas, thereby maintaining the purity of the deposited copper and increasing the crystalline fineness. These merits enhance the strength of bond between the deposited copper layer and the surfaces of the body 40, thereby increasing the Q value. It has been found that the sodium hypophosphite facilitates the depositing of copper on the outside surfaces of the body 40 and the inside surface of the bore 50, thereby improving the Q characteristics.

Figure 12:
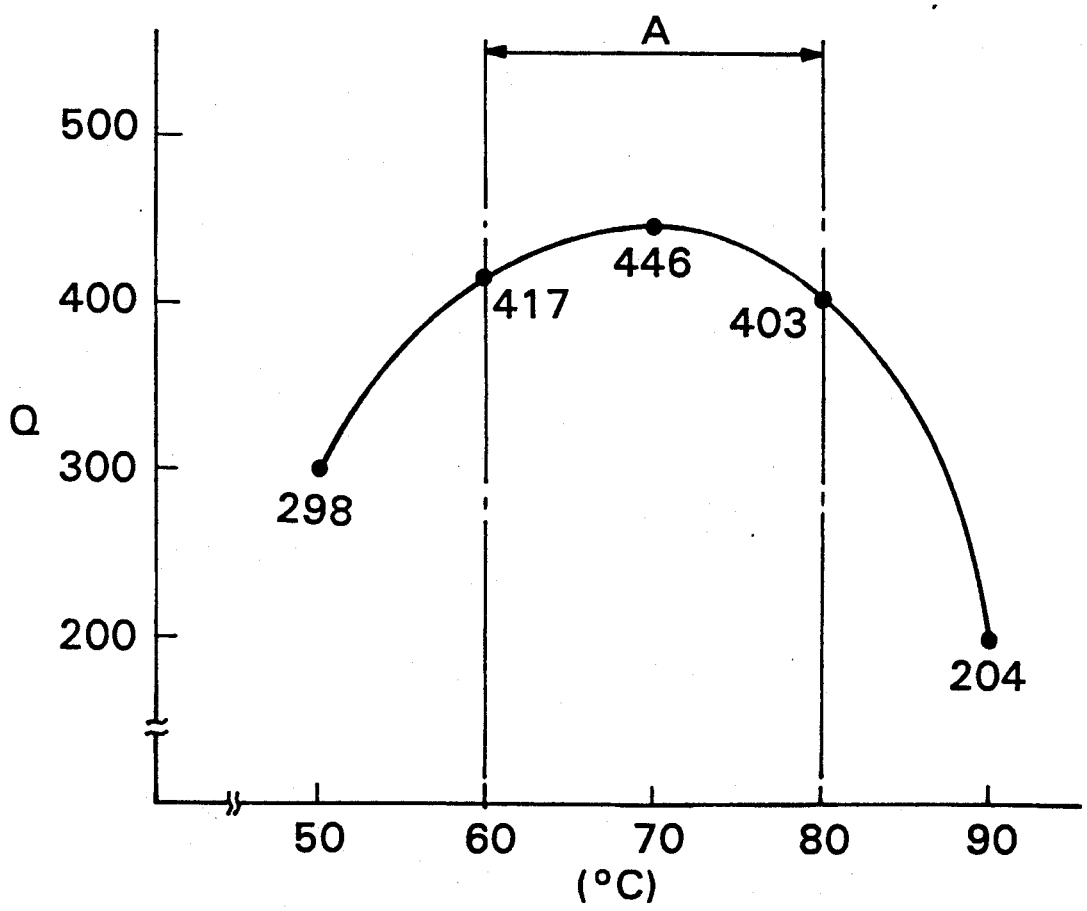
FIG. 12 is a graph showing the relationship between the temperatures at which an electroless plating is conducted and the Q value.

As shown in FIG. 12, better Q characteristics were obtained when the plating was carried out under the thermal condition indicated by (A) in which the plating bath was heated at temperatures ranging from 60° C. to 80° C., but when the temperature was lower than 60° C., an uneven deposit of copper results, and the bond of the copper layer was poor. When it was higher than 80° C., the plating bath was likely to decompose, thereby resulting in coarse crystals of copper.

Figure 13:
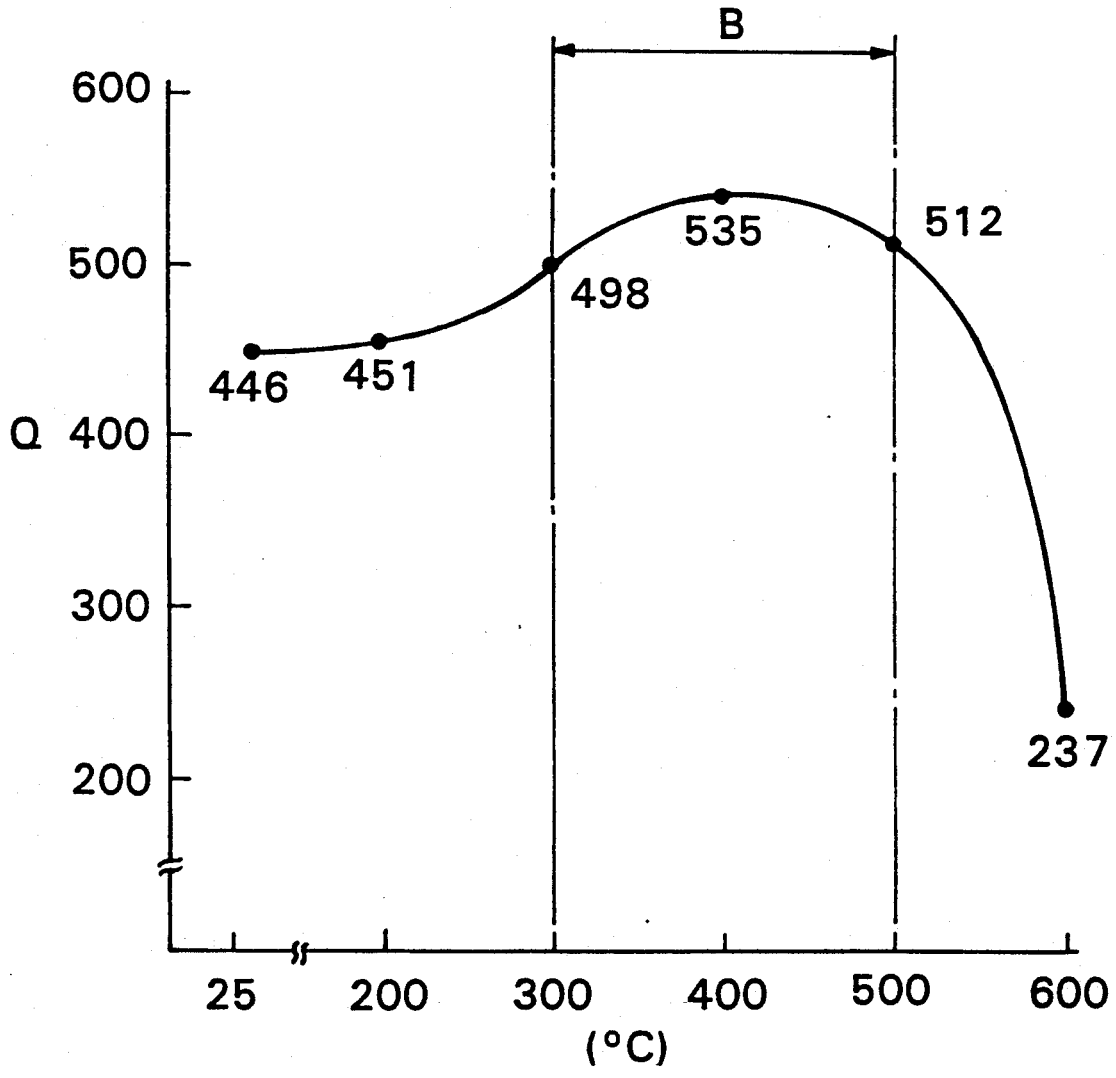
FIG. 13 is a graph showing the relationship between the temperatures at which a vacuum heat treatment and the Q value in one embodiment.
Figure 14A:
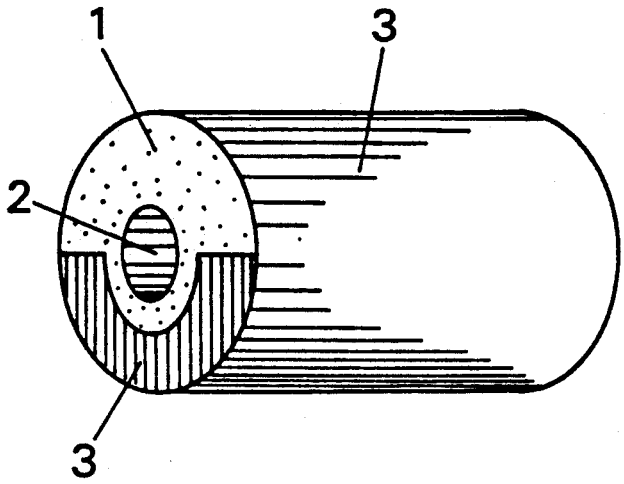
FIGS. 14(A) and (B) are a perspective view and a cross-sectional view showing a conventional dielectric resonator.
Figure 14B:
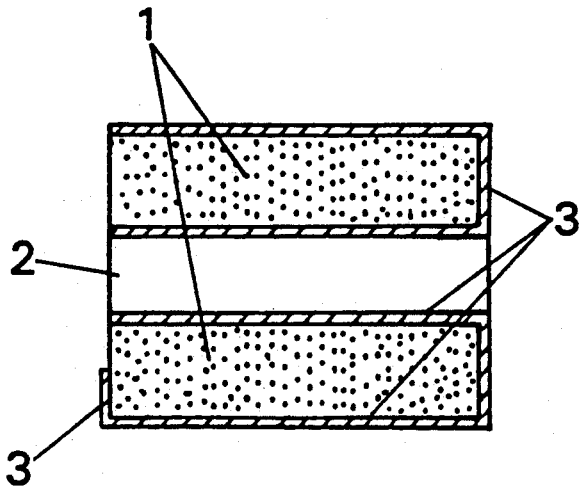

FIG. 13 shows that excellent Q characteristics have been obtained by carrying out electroless plating at a vacuum.

The vacuum condition increases the crystalline fineness, and also strengthens the bond between the copper layer and the surfaces of the body 40.

As shown in FIG. 13, the optimum range is the zone indicated by (B) where the temperature is in the range of 300° to 500° C. If the temperature is higher than 500° C., the body 40 is liable to alteration, thereby reducing the Q characteristics. If the temperature is lower than 300° C., the crystals remain coarse, thereby making no contribution to the improvement of the Q characteristics.

Industrial Applicability

A body of dielectric ceramic is mechanically roughened on its surfaces, and the roughened surfaces are finely roughened by a chemical method such as by etching so that the dually roughened surfaces secure a strong bond between the plating deposit (electrode) and the body. The process is simplified with the minimum number of steps, and is suitable for mass production. Regardless of the mass production the resonators maintain excellent Q value.

One advantage of the present invention is that the inside surfaces of the bores are evenly covered with a deposited layer. Another advantage is that many bodies can be subjected to electroplating at one time without causing uneven coverage of deposit. The productivity is enhanced.

According to the present invention, the plating bath is improved by the addition of 2,2'bipyridyl and sodium hypophosphite. As a result, the copper deposit is secured to the surfaces of the bodies and the bores and its purity is maintained by preventing hydrogen gas and univalent copper oxide from being intruded into the deposit, thereby enhancing the crystalline fineness. Thus the Q characteristics of dielectric resonators are improved. When the the copper deposit obtained by electroless copper plating is heat treated at a vacuum, the Q characteristics are remarkably improved.

We claim:

1. A plating device which comprises a rotor submerged in an electrolyte, the rotor having a major plane and being mounted on an axis which is generally perpendicular or inclined to the major plane of the rotor, the rotor including supporting pins adapted to support resonators, and means for driving the rotor, the surface of the rotor being provided with hills and valleys, the supporting pins being fixed on the hills.

2. A device as defined in claim 1, further comprising a plurality of apertures located between adjacent supporting pins.

3. A device as defined in claim 1, wherein the supporting pins are made of metal.

4. A device as defined in claim 3, wherein the supporting pins are coated with a plating metal.

5. A device as defined in claim 1, wherein the rotor is provided with a rotary shaft bore in which a rotary shaft is supported.

6. A device as defined in claim 5, wherein the rotary shaft bore is vertical or inclined to the surface of the rotor.

7. A plating device according to claim 1 which comprises at least two of said rotors submerged in an electrolyte, and means for rotating at least some of the rotors in opposite directions.

8. A plating device which comprises a rotor submerged in an electrolyte, the rotor having a major plane and being mounted on an axis which is generally perpendicular or inclined to the major plane of the rotor, the rotor including supporting pins adapted to support resonators, and means for driving the rotor, the supporting pins being generally perpendicular or inclined to the major plane of the rotor, the surface of the rotor being provided with hills and valleys, the supporting pins being fixed on the hills.

9. A device as defined in claim 8, further comprising a plurality of apertures located between adjacent supporting pins.

10. A device as defined in claim 8, wherein the supporting pins are made of metal.

11. A device as defined in claim 10, wherein the supporting pins are coated with a plating metal.

12. A device as defined in claim 8, wherein the rotor is provided with a rotary shaft bore in which a rotary shaft is supported.

13. A device as defined in claim 12, wherein the rotary shaft bore is vertical or inclined to the surface of the rotor.

14. A plating device according to claim 8, which comprises at least two of said rotors submerged in an electrolyte, and means for rotating at least some of the rotors in opposite directions.

* * * * *